United States Patent [19]

Pelz

[11] Patent Number: 5,039,098

[45] Date of Patent: Aug. 13, 1991

[54] GOLF CLUB HAVING AN ALIGNING AND QUICK CONNECT-DISCONNECT COUPLING BETWEEN THE GOLF CLUB SHAFT AND CLUB HEAD

[76] Inventor: David T. Pelz, 436 Seawind, Austin, Tex. 78746

[21] Appl. No.: 167,162

[22] Filed: Mar. 11, 1988

[51] Int. Cl.[5] ..... A63B 53/02

[52] U.S. Cl. ..... 273/80.1; 273/80.8

[58] Field of Search ..... 273/80.1, 80.2, 80.5, 273/80.7, 80.6, 80.8, 80 R, 80 A–80 D, 80.3, 80.4, 80.9, 167 G, 77 R; 403/341, 160, 339, 340, 286; 81/177.1, 489; 16/110 R

[56] References Cited

U.S. PATENT DOCUMENTS

| | | | |
|---|---|---|---|
| 1,972,653 | 1/1889 | Hart | 403/340 |
| 2,203,893 | 6/1940 | Chapman | 273/80.2 |
| 2,361,415 | 10/1944 | Reach | 273/80.5 |

FOREIGN PATENT DOCUMENTS

| | | | |
|---|---|---|---|
| 443439 | 2/1936 | United Kingdom | 273/80.7 |

*Primary Examiner*—Edward M. Coven
*Assistant Examiner*—Sebastiano Passaniti
*Attorney, Agent, or Firm*—N. J. Aquilino

[57] ABSTRACT

A golf club wherein the club head and shaft are interchangeable using a quick connect-disconnect coupling between the club shaft and the club head. The coupling includes means for aligning and preventing rotation between the club head and shaft including an angular alignment surface on the lower end of the shaft which cooperates with an angular alignment stop formed within the heel of the golf club head. The coupling further includes a means for connecting the shaft to the golf club head when the shaft is in place within the heel of the club head.

7 Claims, 1 Drawing Sheet

12
32
34
10
20
18
30
16
14
36
22
40
38
24
28
42

52
54
50
58
56
72
74
60
70
68
64
76
62
66

GOLF CLUB HAVING AN ALIGNING AND QUICK CONNECT-DISCONNECT COUPLING BETWEEN THE GOLF CLUB SHAFT AND CLUB HEAD

BACKGROUND OF THE INVENTION

This invention relates to golf clubs and, in particular, to a coupling structure for connecting a golf club shaft to a golf club head.

Golf club heads are normally connected to the shaft in a permanent manner and once a golf club is constructed the head and the shaft can only be separated by a time consuming disassembly and reassembly process. The advancement of technology in the golf business has produced a large variety of golf club heads and shafts which in turn produce a wide variety of playing characteristics adapted to suit the needs of an individual golfer. Absent a convenient way to make heads and shafts interchangeable, the golfer must either have a large number of clubs with specific characteristics, or must change a particular club using a complicated disassembly and reassembly process. If, for example, a golfer would prefer to test or play a golf club shaft with different flex characteristics, or use a club head with a different weight, heretofore it has not been practical to make such changes quickly, by changing the components themselves, but rather by using different complete golf clubs which have several difference components each, instead on the one only which the golfer desired to use.

Ideally, golf club heads and shafts would be interchangeable, however, various attempts which have been made at providing this interchangeability have not gained popularity in the golf club industry.

THE PRESENT INVENTION

The present invention relates to a mechanical quick connect-disconnect system for coupling a golf club shaft with a golf club head. This unique system contemplates making the mechanical connection through the interior of the club shaft and along the shaft axis, and requires no force or penetration to be placed on the outside of or through the shaft walls. This arrangement maintains the structural and positioning integrity of the shaft, while providing the necessary coupling force to maintain a solid connection between the shaft and the club head.

The assembly includes a cylindrical member called a shaft stop which is placed within the hosel of the golf club head or in the head itself, having an exterior diameter which closely corresponds to the outside diameter of a golf club shaft. This member includes a smaller interior bore to accommodate a conventional machine screw. The end of the cylindrical shaft stop member is finished at an oblique angle. This member is rigidly affixed to the club head or hosel itself.

The shaft is provided with a solid plug with an internal threaded bore which corresponds to the threads of the machine screw. The end of the shaft is cut at the same oblique angle as the interior cylindrical member. To assemble the club head, the shaft is placed within the hosel or head and rotated until the oblique end of the shaft abuts the oblique end of the interior cylindrical member. The machine screw within the head is then turned within the bore of the interior cylindrical member and threaded into the threaded plug within the shaft until the connection is tight.

In some golf club head configurations an additional cylindrical sleeve can be utilized to locate and hold the above-mentioned cylindrical shaft stop member and shaft member in place.

To change shafts or disconnect the head it becomes a simple matter of unloosening the machine screw and removing the shaft from within the hosel sleeve or club head to separate the club head and shaft. Either the shaft or another head may be replaced to provide a golf club with different playing characteristics.

Among the objects of the present invention are the provision of a coupling system for a golf club shaft and club head which are easily and quickly connected and/or disconnected enabling a variety of shaft and club head combinations to be used, tested or evaluated.

A further object of the present invention is to provide a golf club head and shaft coupling system which provides a golfer a variety of adjustments in shaft and club head structures enabling him to create a golf club which is ideally suited for his individual playing characteristics.

It is still a further object of the invention to provide a golf club system whereby a player can make club change without the necessity of having a number of different golf clubs.

These and other objects of the present invention will become apparent with reference to the following specification and accompanying drawings.

DESCRIPTION OF THE DRAWINGS

FIG. 3 shows the present invention used with an iron type golf club head.

DESCRIPTION OF THE PREFERRED EMBODIMENT

Figure 1:
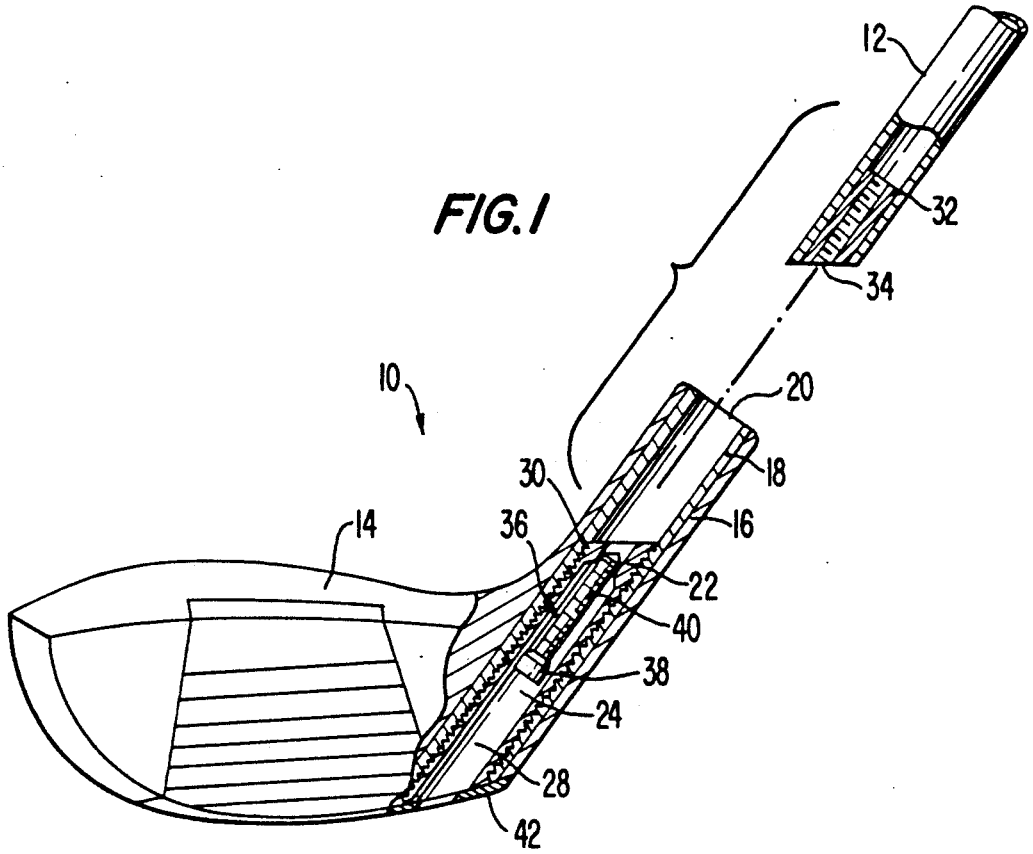
FIG. 1 shows an exploded perspective view of a golf club in accordance With the present invention.
Figure 2:
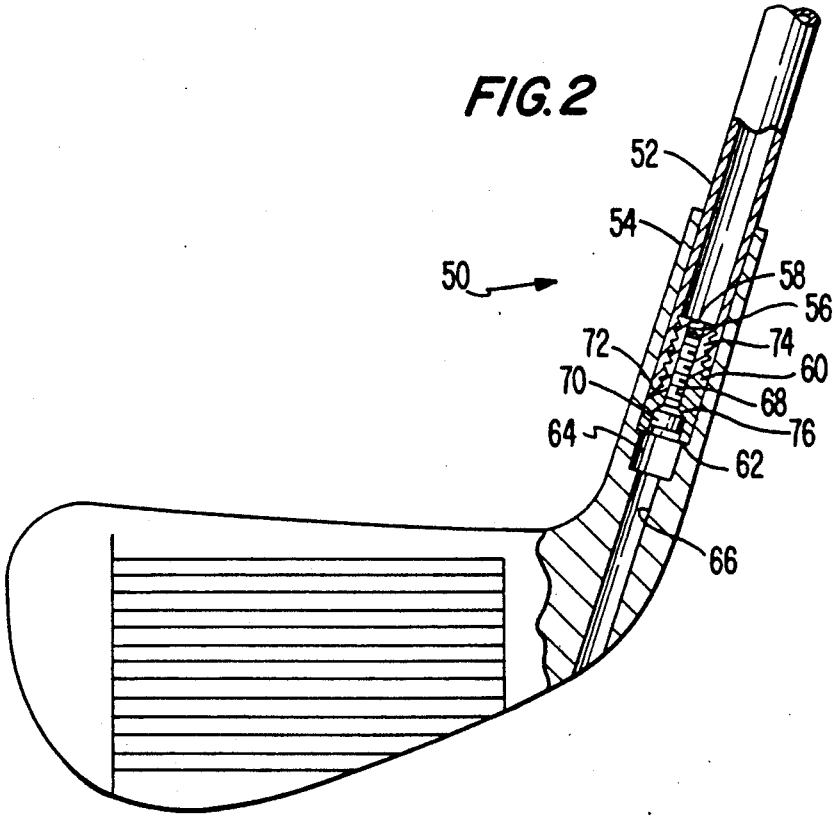
FIG. 2 is a detail of FIG. 1.

Referring to FIGS. 1 and 2, a golf club 10 formed of the present invention includes a shaft 12 with a handle (not shown) and a wood-type club head 14. The hosel 16 of the club head 14 is provided with a hosel sleeve 18 which is rigidly secured within a preformed bore of the club head 14. The inside diameter 20 of the upper portion of the sleeve 18 is slightly larger than the outside diameter of the shaft 12 and is adapted to receive the shaft when the golf club is assembled. The lower end of the sleeve is provided with a shaft stop 22. The shaft stop 22 includes a bore 24 along its axis centrally located having a first section of smaller diameter 26 and a second section of slightly larger diameter 28 separated by a shoulder 30.

The shaft 12 includes an insert 32 having a threaded bore 34 along its axis. The end of the shaft 12 and the end of the insert 32 are formed at an oblique angle, as shown in the drawings, which corresponds to the oblique angle of the top of the shaft stop 22. A suitable machine screw 36, having a head 38 and threads, 40 fits into the threaded bore 34 of the shaft liner sleeve 32 when the club head 14 and shaft 12 are assembled.

To assemble the golf club, a shaft 12 including the threaded shaft liner 32, cut at a suitable oblique angle, is inserted into the bore 20 of the sleeve 18. The shaft 12 may be suitably rotated so that the lower end of the shaft abuts the oblique bottom portion of the shaft stop 22. The machine screw 36 is then threaded into the threaded bore 34 on the shaft liner 32. The head 38 of the machine screw 36 will abut the shoulder 30 so that the shaft 12 is pulled down against the top of the shaft stop 22 and secured in this position as the screw 36 is tightened. The wrench or turning device for the screw 36 inserts through a hole in the bottom sole plate 42, keeping the screw 36 within the central bore 24 of the shaft stop 22.

When it is desired to interchange shafts and heads, it becomes a simple matter of unscrewing the screw 36 with a suitable tool until the shaft is separated from the head.

FIG. 3 illustrates a shaft coupling in accordance with the present invention as used on an iron type golf club 50. A shaft 52 is shown inserted within the hosel 54 of the iron club head. The shaft is provided with a liner 56 having a threaded bore 58. The end of the shaft 52 and the liner are formed at an oblique angle, as shown in the drawings. The iron head includes a shaft stop 60 which is inserted within the hosel of the club head 50. The shaft stop abuts an annular shoulder 62 in order to position itself within the hosel 54. The end of the shaft stop is formed at an oblique angle which corresponds to the oblique angle at the end of the shaft and shaft liner. The hosel includes a chamber 64 below the shaft stop 60 and a longitudinal bore 66 which extends through the bottom of the club head. A suitable machine screw 68 having a head 70 and threads 72 is sized to fit within the threaded bore 58 of the shaft liner and the chamber 64. The screw 68 is adapted to fit within a bore 74 within the shaft stop 60 and engage a shoulder 76 on the shaft stop which abuts the head 70 of the machine screw 68. The machine screw is adapted to be freely moveable within the chamber 64 when it does not engage the threaded shaft liner 58 and it is accessible through the longitudinal access hole 66 from the bottom of the club head.

In operation, a shaft is inserted within the hosel and rotated so that the angularly disposed bottom of the shaft and liner abut with the angularly disposed shaft stop. A suitable tool is placed within the access opening 66 and the machine screw is located within the central bore of the shaft stop and it is engaged with the threaded bore 58. Tightening the screw pulls the shaft downwardly within the hosel until the head 70 of the screw 68 abuts the shoulder 76 of the shaft stop. This causes a tight connection between the shaft and the golf club head.

I claim:

1. A golf club having a shaft and club head, said club head including a heel, toe and bottom plate wherein the improvement comprises:

an internal axial aligning and coupling system for aligning and coupling of said shaft with said club head;

said internal axial aligning and coupling system being characterized by an interior bore formed within said heel of said golf club head;

a shaft stop located within said interior bore, within said heel;

a lower end on said shaft sized to fit within said interior bore and about said shaft stop;

first coupling means within the said lower end of said shaft;

second coupling means within said interior bore for forming a connection with said first coupling means; and, means for aligning and preventing relative motion between said shaft and said shaft stop including a first alignment member on said shaft stop and a second alignment member on said lower end of said shaft, said first and said second alignment members formed at an oblique angle with respect to the central longitudinal axis of said shaft, said first alignment member on said shaft stop formed by an upper surface thereon and said second alignment member formed by a bottom surface on said lower end of said shaft, said bottom surface of said shaft and said top surface of said shaft stop being structured to abut each other when said shaft and said shaft stop are in alignment permitting said first and said second coupling means to connect said shaft to said club head.

2. The golf club of claim 1 further characterized by a sleeve located within said interior bore, said sleeve having an opening structured at its upper end to receive said shaft and structured at its lower end to receive said shaft stop.

3. The golf club of claim 2 wherein said first coupling means is further characterized as a threaded bore and said second coupling means is further characterized as a threaded fastener sized to be screwed into said threaded bore.

4. The golf club of claim 3 wherein said first coupling means is further characterized by an insert secured within said lower end of said shaft, and wherein said internal threads are formed within said insert.

5. The golf club of claim 3 wherein said threaded fastener is located within said lower end of said opening in said sleeve.

6. The golf club of claim 5 further characterized by said first alignment member being an angular flat surface and said second alignment member being a corresponding flat angular surface, said angular surfaces being structured to abut each other when said shaft and said club head are aligned.

7. The golf club of claim 1 wherein said first and second coupling means are aligned with the central longitudinal axis of said shaft.

* * * * *